US010260310B2

(12) United States Patent
Zhao et al.

(10) Patent No.: US 10,260,310 B2
(45) Date of Patent: Apr. 16, 2019

(54) HIGH TEMPERATURE AND PRESSURE PACKER

(71) Applicant: Baker Hughes, a GE company, LLC, Houston, TX (US)

(72) Inventors: Lei Zhao, Houston, TX (US); Zhiyue Xu, Cypress, TX (US); Zhi Yong He, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 9 days.

(21) Appl. No.: 15/645,704

(22) Filed: Jul. 10, 2017

(65) Prior Publication Data

US 2019/0010779 A1 Jan. 10, 2019

(51) Int. Cl.
*E21B 33/128* (2006.01)
*E21B 43/26* (2006.01)

(52) U.S. Cl.
CPC ..... *E21B 33/128* (2013.01); *E21B 43/26* (2013.01)

(58) Field of Classification Search
CPC ..... E21B 33/128; E21B 43/26
See application file for complete search history.

(56) References Cited

U.S. PATENT DOCUMENTS 3,445,552 A * 5/1969 Clement ..... B29C 53/30 264/322
3,517,742 A * 6/1970 Williams ..... E21B 33/1216 166/134
5,944,102 A 8/1999 Kilgore et al.
6,041,858 A 3/2000 Arizmendi
6,073,692 A * 6/2000 Wood ..... E21B 33/12 166/187
6,102,117 A 8/2000 Swor et al.
6,827,150 B2 12/2004 Luke
7,090,025 B2 * 8/2006 Haugen ..... E21B 43/103 166/207
7,341,110 B2 * 3/2008 Doane ..... E21B 23/06 166/134
7,387,170 B2 * 6/2008 Doane ..... E21B 23/06 166/134
7,493,945 B2 * 2/2009 Doane ..... E21B 23/06 166/134
8,109,340 B2 2/2012 Doane et al.
(Continued)

*Primary Examiner* — Matthew R Buck
*Assistant Examiner* — Aaron L Lembo
(74) *Attorney, Agent, or Firm* — Shawn Hunter

(57) ABSTRACT

A high pressure high temperature packer features an actuation assembly of a plurality of rings rotationally locked to a mandrel and initially spaced apart. A pressure actuated piston responsive to tubing pressure pushes the actuation rings together. Spring discs also rotationally locked to the mandrel are between pairs of actuation rings that feature a circumferential protrusion. On application of axial force the protrusion engages a sloping portion of the spring disc and moves the sloping portion toward a more vertical orientation. A corrugated tube surrounds the spring discs with a curled end of each spring disc engaged to an internal tube corrugation. A seal element is on the external corrugations of the tube. The spring discs expand the tube to bring the sealing element and external tube peaks to the borehole wall. Slots in the spring disc allow irregular growth of the tube to conform to surface irregularities.

24 Claims, 5 Drawing Sheets

(56) References Cited

U.S. PATENT DOCUMENTS

| | | | | |
|---|---|---|---|---|
| 8,347,505 | B2 * | 1/2013 | Urban | F16F 1/025 166/137 |
| 8,651,178 | B2 * | 2/2014 | Mercer | E21B 23/06 166/121 |
| 8,701,787 | B2 | 4/2014 | Shkurti et al. | |
| 8,714,273 | B2 * | 5/2014 | Lynde | E21B 33/1212 166/179 |
| 8,973,667 | B2 * | 3/2015 | Hedrick | E21B 33/128 166/387 |
| 2003/0042028 | A1 | 3/2003 | Lauritzen et al. | |
| 2005/0189120 | A1 * | 9/2005 | Doane | E21B 23/06 166/387 |
| 2005/0189121 | A1 * | 9/2005 | Doane | E21B 23/06 166/387 |
| 2008/0196884 | A1 * | 8/2008 | Doane | E21B 23/06 166/134 |
| 2009/0308592 | A1 * | 12/2009 | Mercer | E21B 23/06 166/134 |
| 2010/0038073 | A1 * | 2/2010 | Carro | E21B 33/1295 166/120 |
| 2010/0294485 | A1 * | 11/2010 | Lynde | E21B 33/1212 166/179 |
| 2013/0180734 | A1 * | 7/2013 | Hedrick | E21B 33/1208 166/387 |
| 2014/0041858 | A1 * | 2/2014 | Sun | E21B 33/12 166/179 |

* cited by examiner

HIGH TEMPERATURE AND PRESSURE PACKER

FIELD OF THE INVENTION

The field of the invention is annular barriers for borehole use and more particularly where the sealing element assembly is radially actuated from outside a mandrel and conforms to irregular borehole shapes and exhibits anti-extrusion capabilities between opposed ends.

BACKGROUND OF THE INVENTION

There are many applications where zones in a borehole need isolation from each other in an annular space between a tubular string and the borehole wall. The borehole wall can be the formation and is referred to as open hole or there can be one or more casing strings attached in series in the case of a cased hole. Apart from the structure and shape of the borehole wall there are a large number of designs for annular barriers that need to span the gap between a tubular string in the borehole and the borehole wall. There are also a broad range of operating conditions that dictate the use of some known designs as opposed to others. In some cases the controlling criteria is pressure differential or/and service temperature. In other cases the percent expansion from the run in to the set dimension for the sealing element is controlling. Some designs use an external sleeve on a mandrel and internally expand the mandrel for high pressure isolation where there may be high temperatures well over 400 F, as shown in US 2003/0042028. Many designs simply axially compress an annularly shaped sealing element and employ embedded stiff rings at the opposed ends to control seal element extrusion as in U.S. Pat. No. 6,102,117. Others specially design the slip assemblies to handle high pressure differentials such as barrel shaped slips shown in U.S. Pat. No. 5,944,102. Yet other designs push a sealing element up a ramp to axially compress it and to bring it to the surrounding borehole wall as in U.S. Pat. No. 8,109,340. Some high expansion designs are shown in U.S. Pat. Nos. 6,827,150 and 6,041,858. Another design provides an extrusion barrier for a sealing element in the form of a slotted ring as in U.S. Pat. No. 8,701,787.

As an alternative to these designs a high pressure and temperature annular barrier is presented with a host of unique features. While actuation starts with an axial force along a mandrel that force moves a plurality of rings closer together. In between the actuation rings are spring discs rotationally locked to a mandrel. The actuation rings have an exterior circumferential projection which catches a sloping segment of an adjacent spring disc to exert a pivoting motion on the sloping portion of the spring disc such that a curled outer segment that is registered with a depression in a surrounding corrugated member results in pushing a respective corrugation radially. Externally the corrugated member has a series of valleys spaced between peaks. Those skilled in the art will not that the internal valleys where curled segments engage also define the spaced external peaks. A sealing material is disposed in the external valleys between the external peaks. The tube shaped corrugated member is design to yield as the sealing material in its outer valleys is pushed to the borehole wall. Because the sloping segment of the spring discs essentially rotates about the outer surface of the mandrel, the exterior valleys of the corrugated member get axially squeezed as the external peaks approach the borehole wall. This effect pushes the sealing material in the external valleys of the corrugated member out toward the borehole wall for enhanced sealing contact. The external peaks of the corrugated member also serve to control seal material extrusion in the axial direction along the length of the seal material as opposed to prior designs that focused extrusion control at ends of sealing elements. The corrugated member can be formed with one or more continuous spirals so that the sealing elements in the external groove can be continuous. Alternatively, the corrugations can be an array of parallel peaks and valleys with each external valley having a discrete seal ring. Optionally a the corrugated member itself can be a sealing element by the manner in which it is built such as with an external resilient coating that can handle the operating temperatures as high as 600 F. These and other features will be more readily appreciated from a review of the detailed description of the preferred embodiment and the associated drawings while recognizing that the full scope of the invention is to be determined from the appended claims.

SUMMARY OF THE INVENTION

A high pressure high temperature packer features an actuation assembly of a plurality of rings rotationally locked to a mandrel and initially spaced apart. A pressure actuated piston responsive to tubing pressure pushes the actuation rings together. Spring discs also rotationally locked to the mandrel are between pairs of actuation rings that feature a circumferential protrusion. On application of axial force the protrusion engages a sloping portion of the spring disc and moves the sloping portion toward a more vertical orientation. A corrugated tube surrounds the spring discs with a curled end of each spring disc engaged to an internal tube corrugation. A seal element is on the external corrugations of the tube. The spring discs expand the tube to bring the sealing element and external tube peaks to the borehole wall. Slots in the spring disc allow irregular growth of the tube to conform to surface irregularities.

DETAILED DESCRIPTION OF THE PREFERRED EMBODIMENT

Figure 1:
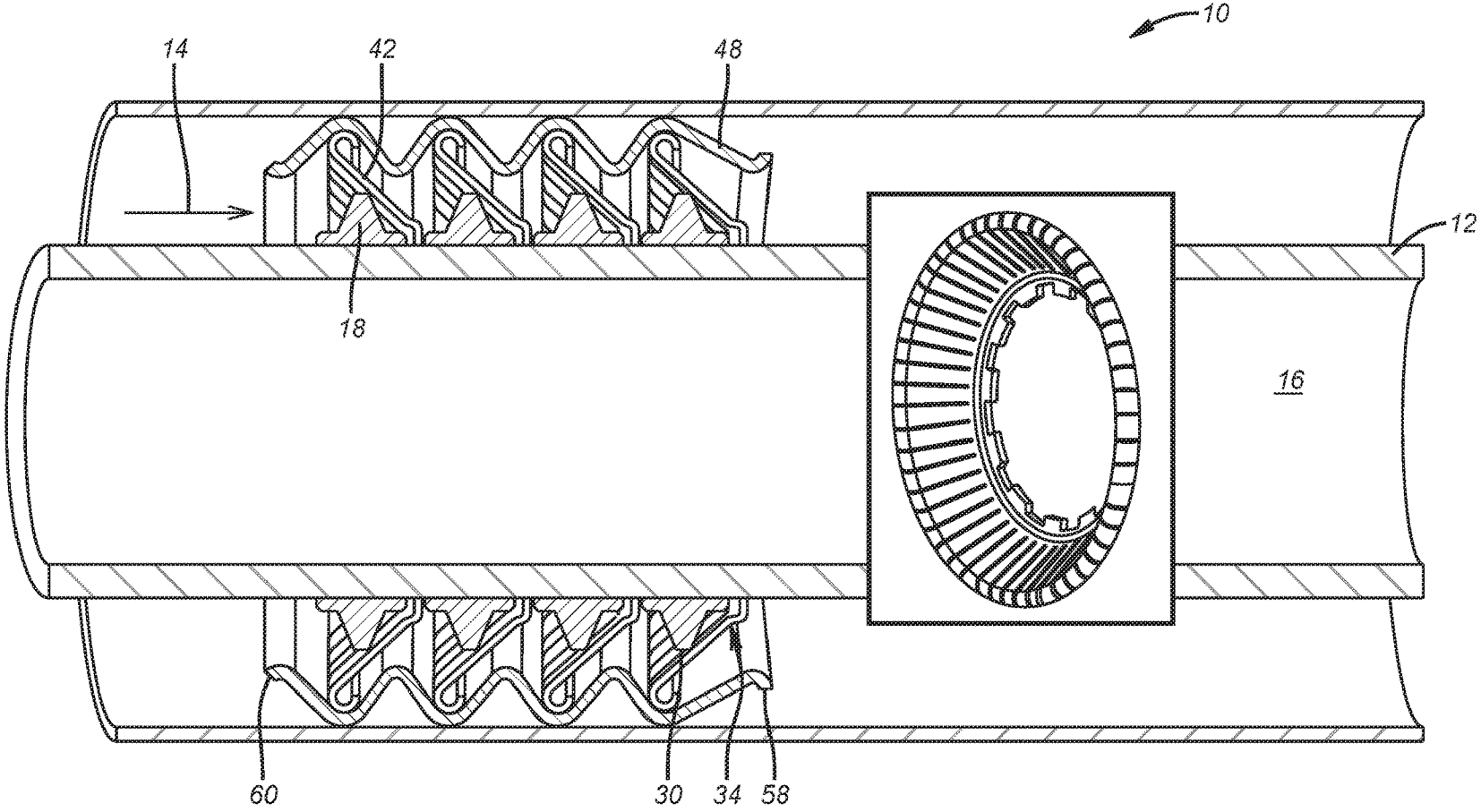
FIG. 1 is a section view of the packer in the set position with an inset enlarged perspective view of the spring disc.

Referring to FIG. 1, the elements of the packer 10 will be described. Mandrel 12 has preferably a tubing pressure actuation and selective locking system of a type known in the art and is schematically represented by arrow 14. This system can involve a wall port to an annular piston whose axial movement can be releasably locked such as with a body lock ring that can subsequently be undermined in the packer 10 is to be retrievable. Typically tubing passage 16 would be isolated below a wall port to the annular piston by a ball dropped on a seat. Applied pressure on the seated ball is communicated to the annular piston for the exertion of a setting force on the packer 10 in the direction of arrow 14. The force generation for setting packer 10 can be downhole from it as opposed to uphole as shown.

Figure 2:
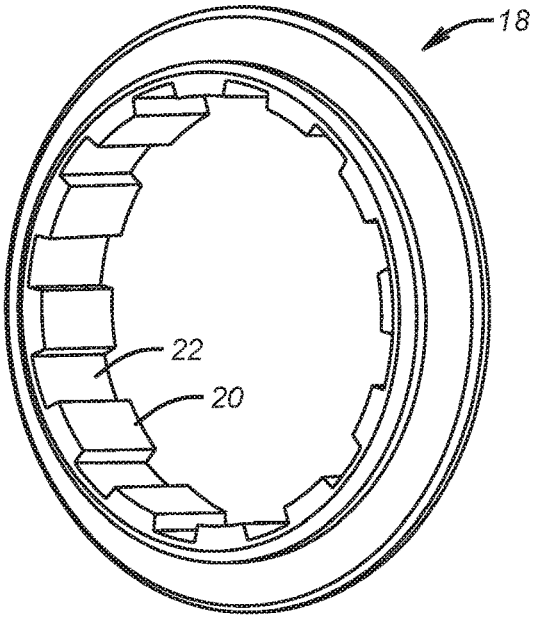
FIG. 2 is a perspective view of an actuator ring.
Figure 3:
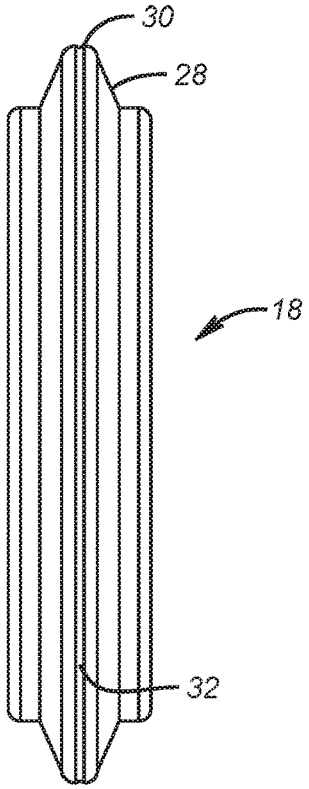
FIG. 3 is an outside end view of the actuator ring of FIG. 2.
Figure 4:
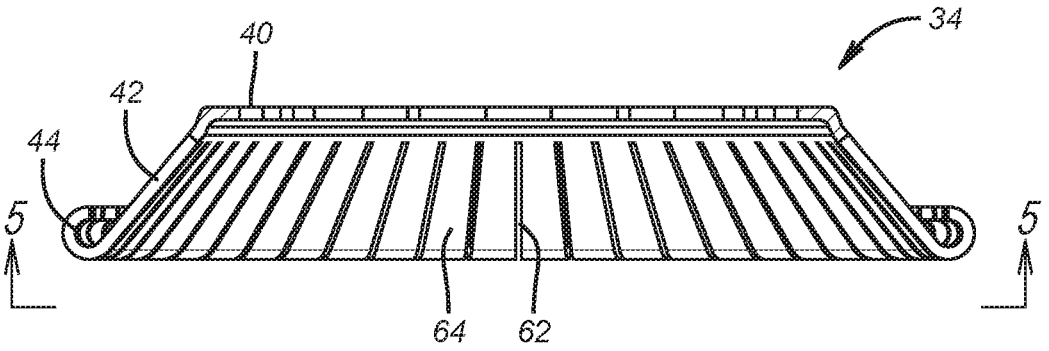
FIG. 4 is a section view of the spring disc.
Figure 7:
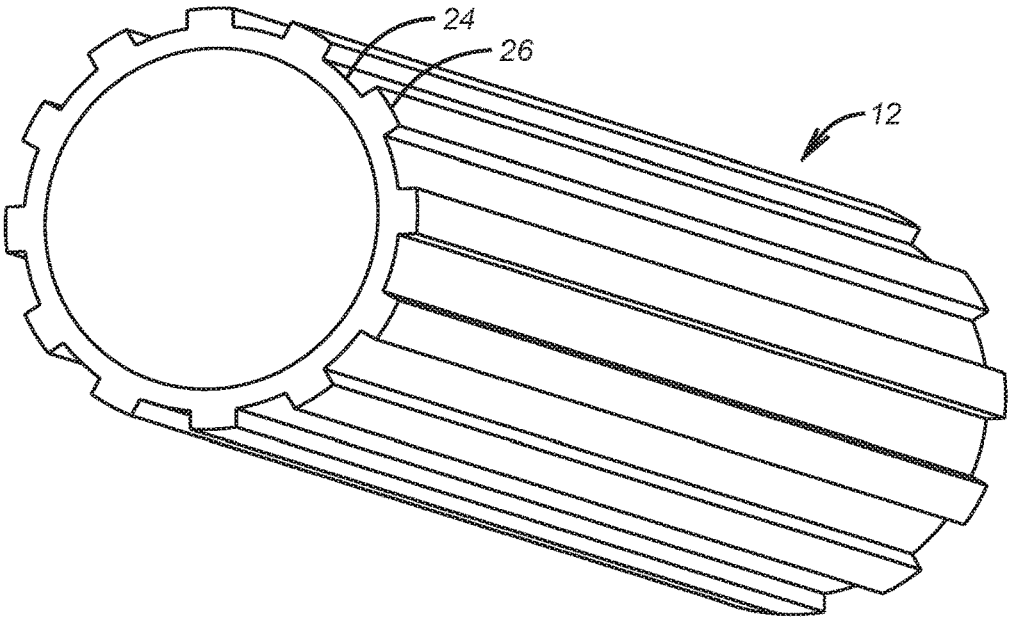
FIG. 7 is a perspective view of the mandrel showing a rotational locking feature.

A series of actuator rings 18 are shown in more detail in FIGS. 2 and 3. It features alternating projections 20 and depressions 22 that respectively engage depressions 24 and projections 26 on mandrel 12 that are shown in FIG. 7. In this manner the actuator rings 18 are able to slide axially when the schematically illustrated actuation force shown as arrow 14 is applied. The actuator rings 18 are thus rotationally locked to the mandrel 12. While the array of meshing projections and depressions that register with each other between the mandrel 12 and the actuator rings 18 appears as alternating quadrilateral shapes in section, other meshing patterns and shapes are contemplated to achieve rotational locking. As another alternative the mandrel 12 and actuator rings 18 can be rotationally locked with one or more keys on one in a keyway on the other. Optionally, the rotational locking can also be eliminated.

Referring back to FIGS. 2 and 3, the actuator rings have a circumferential projection 28 that is shown continuous but can be in separated segments with a taper toward apex 30. Apex 30 need not come to a point and can be flat or another shape, although flat is illustrated. Optionally, there can be an insert in a circumferential groove 32 in the apex 30. As best seen in FIG. 1, the side or top of the apex 30 is what makes contact with spring disc 34 when the actuation system 14 is energized.

Figure 5:
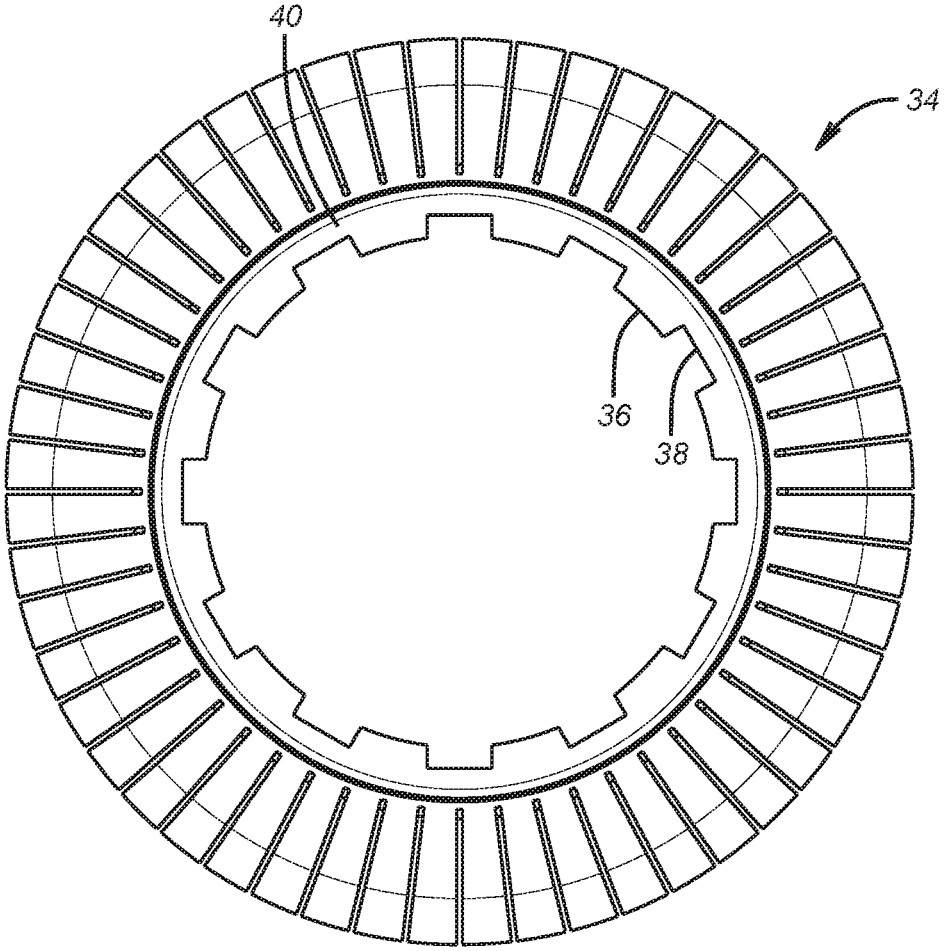
FIG. 5 is an end of the spring disc of FIG. 4 taken along line 5-5.
Figure 6:
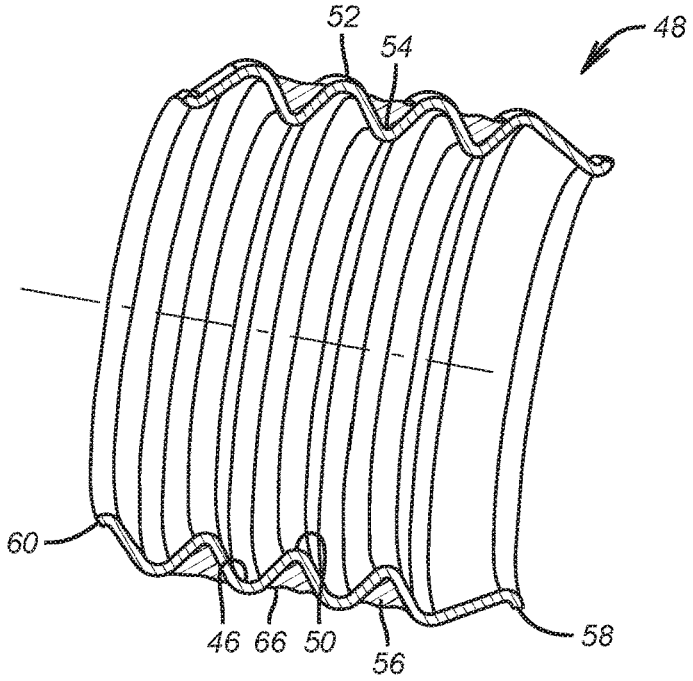
FIG. 6 is a section view of the tubular sealing element support.
Figure 8:
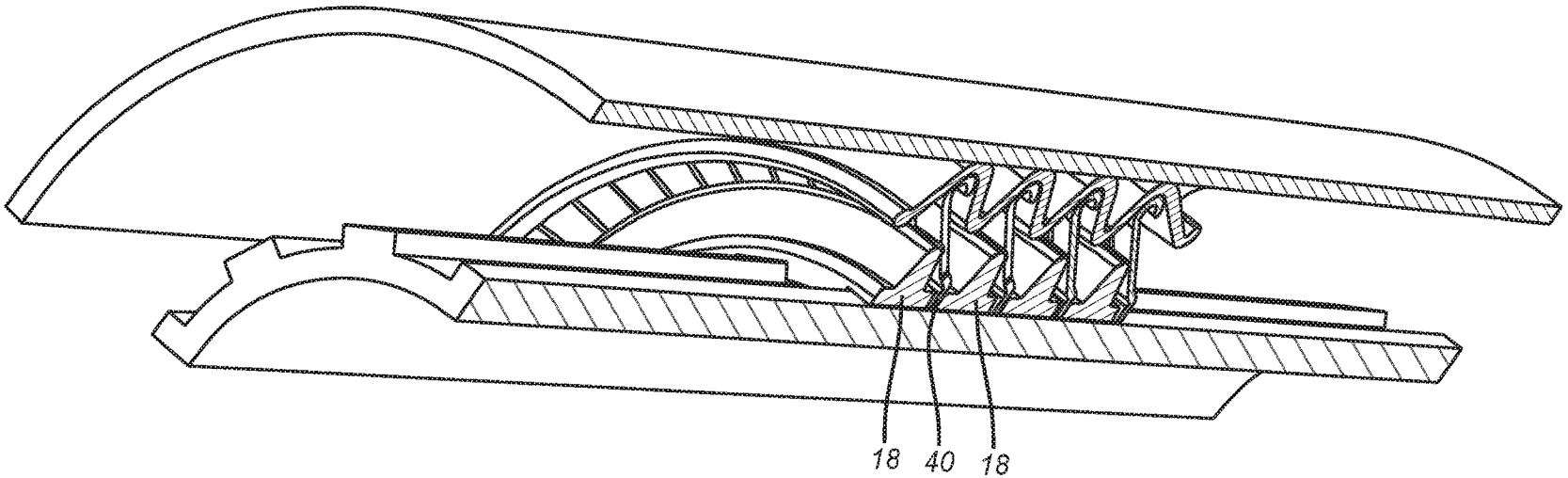
FIG. 8 is a perspective view of FIG. 1 with the packer in the set position.

The details of spring discs 34 are best seen in FIGS. 5 and 6. Discs 34 are mounted to mandrel 12 in much the same manner as actuator rings 18 and in an alternating pattern shown in FIGS. 1 and 8. Discs 34 are preferably locked to mandrel 12 against relative rotation but that feature is also optional. Spring disc 34 has alternating projections 36 and depressions 38 that respectively mesh with depressions 24 and projections 26 on mandrel 12. As with the actuator rings 18 the rotational locking of the spring discs 34 to the mandrel 12 can be accomplished in a variety of ways previously described. Projections 38 and depressions 36 are integral to a base ring 40 which is generally perpendicular to mandrel 12 and retained in that position by being disposed between a pair of actuator rings 18 as shown in FIG. 8 in the set position. Extending from base ring 40 and in a direction away from mandrel 12 is a tapered segment 42 that terminates in a preferably open loop 44. Alternatively, loop 44 instead of having a free end can come back around into contact with tapered segment 42. Loop 44 gives end rigidity to the tapered segment 42. It also engages valleys 46 of tubular sealing element support 48.

Referring to FIG. 6 for some details of the support 48 it can be seen that it resembles a bellows shape with alternating internal peaks 50 and valleys 46. The exterior has alternating peaks 54 and valleys 54. A seal material 56 can fill each exterior valley 54. There are alternatives such as coating the exterior surfaces of support 48 with a resilient material that can take the service temperatures. The support 48 is preferably a soft metal alloy of preferably copper or nickel whose thickness will depend on the desired differential pressure rating. While a bellows design as shown is preferred the configuration can be one or more continuous spirals in which case the sealing material can also be a continuous spiral in a continuous valley 54.

Getting back to the spring disc 34 the tapered segment 42 has spaced slots 62 starting near base ring 40 but on the tapered segment 42 and terminating at the end of loop 44 whether it is open as shown or closed. The slots 62 create a 360 degree array of flexible fingers 64 that have independent movement. This feature comes into play in making the assembly adaptable to respond to a range of borehole sizes due to casing weights, or to borehole wall out of round portions or partial collapse or any other condition that could cause out of roundness in the borehole wall. Of course, in open hole there is a potential for greater out of roundness occurring. However, the preferred use for the described design is in cased hole.

Getting back to FIG. 6 the support 48 has opposed ends 58 and 60. Preferably end 58 is at the opposite end from where the actuation system 14 applies a force to the actuator rings 18 and is closed off and held against a stop on mandrel 12 on a portion of mandrel 12 where the depressions 24 and projections 26 have stopped so that the mandrel 12 outer surface is amenable to be sealed against a closure for end 58. End 60 is also closed against mandrel 12 again in a zone where the depressions 24 and projections 26 have stopped so that the mandrel 12 outer surface is amenable to be sealed against a closure for end 60. The actuation system schematically referred to as 14 is preferably within the closure for end 60 so that applied tubing pressure to an annular piston can apply an axial force directly to the alternating array of actuator rings 18 and spring discs 34. It should be noted that for running in there are axial gaps between the actuator rings 18 so that the support 48 and the seal 56 in valleys 54 is at a smaller dimension for running in. The seal material 56 can be retained in valley(s) 54 with a protective covering for running in. That covering 66 can stay intact or it can disintegrate with time or exposure to well fluids.

FIGS. 1 and 8 show the way the parts described above are assembled and where they are in the set position. These FIGS. will be used to describe the mechanics of how the assembly moves from the run in to the set position. The actuator rings 18 for running in have some space between them axially that closes up as the packer 10 is actuated with the pressure setting assembly 14. Each apex 30 engages tapered segment 42 preferably around midpoint and all the fingers 64 are pivoted clockwise about base ring 40. Loops 44 are nested in valleys 46 of support 48. Each valley 46 has a respective spring disc 34 with its end loop 44 in a respective valley 46. What results is the diameter of support 48 grows radially taking with it the sealing rings or continuous spiral 56. As the radial movement of support 48 occurs, valleys 54 can close up somewhat in the axial direction because support 48 is held fixed at end 58 and the flexing of the tapered segments 42 are toward end 58. This tends to push out the sealing rings or spiral 56 into the surrounding borehole wall and into any irregularities or out of roundness that it might have. Additionally, the peaks 52 are pushed radially out into the surrounding borehole wall and into any irregularities such as out of roundness that may exist. Further, the fact that the fingers 64 can flex independently of each other also helps push the support 48 out further where needed into voids or less where needed if there is a narrowing of the borehole wall in a particular circumferential orientation. The fingers 64 can push out more or less against support 48 and accordingly against seal 56 depending on the borehole contour that is encountered. Moreover, when peaks 52 get pushed against the borehole wall, they act as extrusion barriers at points other than ends of a sealing element as done in the past. If there is a bellows shape to support 48 then there are pairs of peaks 52 for each seal ring 56 between them. On the other hand, if there is a continuous spiral to the shape of support 48 there is in effect a continuous spiral seal 56 flanked on opposed sides with peaks 52 wrapping around the periphery of support 48 one or more times between the ends 58 and 60. Another feature of the packer 10 is that it is set with radial force created between mandrel 12 and sealing element 56 without need for expansion from within the mandrel 12. The radial movement of the assembly of support 48 and sealing element 56 moves radially more reliably than in situations with opposed axial forces on an end of a sealing element which in the past has resulted in part of the element bulging into contact while an adjacent part makes no sealing contact at all with the borehole or other instances where the extending sealing element traps well fluid between itself and the borehole which can compromise the seal. Depending on the configuration of the wall shape of support 48 high expansion applications are also possible where the diameter percentage change between run in and set can exceed 25%. High differential pressure capability is provided from several features at play in the setting of the packer 10. Some of these factors are the sealing element 56 coming out evenly radially and being trapped along its length with peaks 52. Other aspects are the closing of the valleys 54 with seal 56 to increase contact force with the borehole. Finally the radial flexibility of the fingers 64 and the surrounding support 48 further ensures conformity to the borehole shape and heightened contact area for the sealing element 56.

Referring back to the spring disc 34 it has independent use by itself singly or in spaced arrays or in nested stacks. The fact that fingers 64 flex independently allows the spring disc structure to act as an effective tubular centralizer in a borehole as some fingers will more than others to compensate for borehole irregularities. Loop end 44 lends structural rigidity because it forms a stiffer end structure. Making the slots 62 stop short of base ring 40 provides rigidity at an opposite end from loop 44. The shape of spring disc 34 has similarities to Belleville washers and stacks of them can also serve to store and release potential energy. Using the peaks 36 and valleys 38 with a mandrel as described above can keep fingers in a stack of spring disc 34 in alignment so that all the fingers of adjacent spring disc maintain full overlap to avoid binding.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

The above description is illustrative of the preferred embodiment and many modifications may be made by those skilled in the art without departing from the invention whose scope is to be determined from the literal and equivalent scope of the claims below:

We claim:

1. A packer for borehole use, comprising: a mandrel;

a sealing assembly surrounding said mandrel;

an actuation assembly, disposed under said sealing assembly and supported by said mandrel to apply a radial mechanical setting force to said sealing assembly for engaging a surrounding borehole wall;

said actuation assembly pushes said sealing assembly along a length of said sealing assembly variable radial distances in response to resistance offered by the borehole wall;

said sealing assembly comprises a cylindrical shape about said mandrel with a corrugated side wall and said corrugated side wall comprises an inside and outside corrugated side wall;

said actuation assembly comprises at least one spring ring supported by said mandrel and extending into said inside corrugated sidewall; and said actuation assembly further comprises actuator rings on said mandrel on opposed sides of said at least one spring ring such that relative axial movement between said actuator rings and said spring ring flexes said spring ring against said inside corrugated sidewall.

2. The packer of claim 1, wherein:

said at least one spring ring comprises a plurality of spring rings;

said spring rings and actuator rings arranged in an alternating pattern on said mandrel.

3. The packer of claim 2, wherein:

said spring rings rotationally locked to said mandrel.

4. The packer of claim 2, wherein:

said actuator rings rotationally locked to said mandrel.

5. The packer of claim 4, wherein:

said outside corrugated side wall comprises discrete spaced peaks and valleys or at least one continuous spiral peak and valley.

6. The packer of claim 5, wherein:

said discrete peaks or spiral peak contacting the borehole wall.

7. The packer of claim 6, wherein:

said outside corrugated sidewall comprises a resilient coating such that contact of said discrete peaks or spiral peak with the borehole wall seals against the borehole wall.

8. The packer of claim 5, wherein:

said discrete spaced valleys or continuous valley comprising a sealing element.

9. The packer of claim 8, wherein:

said discrete peaks or spiral peak contacting the borehole wall to contain said sealing element from axially extruding from said discrete spaced valleys or continuous valley along an axial length of said cylindrical shape.

10. The packer of claim 9, wherein:

said actuation assembly squeezing said discrete spaced valleys or continuous valley axially against said sealing element to add force to said sealing element when said sealing element is against the borehole wall.

11. The packer of claim 2, wherein:

said spring rings comprise a base ring about said mandrel supporting a tapered segment extending therefrom into contact with said inside corrugated sidewall.

12. The packer of claim 11, wherein:

said actuator rings comprising an outer projection selectively contact a respective said tapered segment to flex said tapered segment against said inside corrugated wall.

13. The packer of claim 12, wherein:

said tapered segment comprising a plurality of radial slots defining fingers therebetween that flex independently.

14. The packer of claim 13, wherein:

said fingers comprising curled ends engaged to a respective valley on said inside corrugated sidewall.

15. The packer of claim 11, wherein:

said tapered segment comprising a plurality of radial slots defining fingers therebetween that flex independently.

16. The packer of claim 15, wherein:

said fingers comprising curled ends engaged to a respective valley on said inside corrugated sidewall.

17. A treatment method for borehole use, comprising:

isolating a portion of a borehole with at least one packer that further comprises a mandrel, a sealing assembly surrounding said mandrel;

making said sealing assembly a cylindrical shape about said mandrel with a corrugated side wall;

providing an inside and outside corrugated sidewall on said corrugated side wall;

providing at least one spring ring supported by said mandrel and extending into said inside corrugated sidewall for said actuation assembly;

an actuation assembly, disposed under said sealing assembly and supported by said mandrel to apply a radial mechanical setting force to said sealing assembly for engaging a surrounding borehole wall;

providing actuator rings of said actuation assembly on said mandrel on opposed sides of said at least one spring ring such that relative axial movement between said actuator rings and said spring ring flexes said spring ring against said inside corrugated sidewall of said sealing assembly; and delivering a material against said at least one packer and to at least one formation adjacent the borehole.

18. The method of claim 17, comprising:

pushing, with said actuation assembly, said sealing assembly along a length of said sealing assembly variable radial distances in response to resistance offered by the borehole wall.

19. The method of claim 17, comprising:

providing a plurality of spring rings as said at least one spring ring;

arranging said spring rings and actuator rings in an alternating pattern on said mandrel.

20. The method of claim 19, comprising:

rotationally locking said spring rings to said mandrel.

21. The method of claim 19, comprising:

rotationally locking said actuator rings to said mandrel.

22. The method of claim 17, comprising:

forming said outside corrugated side wall with discrete spaced peaks and valleys or at least one continuous spiral peak and valley.

23. The packer of claim 22, comprising:

extending said discrete peaks or spiral peak into contact the borehole wall.

24. The packer of claim 17, comprising:

fracturing the formation with said delivering.

* * * * *